United States Patent [19]

Palmer

[11] Patent Number: 4,783,067

[45] Date of Patent: Nov. 8, 1988

[54] HAND EXERCISER DEVICE

[76] Inventor: David L. Palmer, 6606 Wallis Rd., West Palm Beach, Fla. 33413

[21] Appl. No.: 29,576

[22] Filed: Mar. 24, 1987

[51] Int. Cl.[4] ..... A63B 11/08; A63B 21/14; A63B 21/30

[52] U.S. Cl. ..... 272/68; 272/DIG. 4; 272/137; 272/142

[58] Field of Search ..... 272/67, 68, 93, 135, 272/137, 142, DIG. 4, 122, 139; 128/26

[56] References Cited

U.S. PATENT DOCUMENTS

| | | | |
|---|---|---|---|
| Re. 28,845 | 6/1976 | Ratchford | 272/68 |
| 689,652 | 12/1901 | Perry | 272/68 |
| 938,348 | 10/1909 | Stull | 272/68 |
| 1,444,819 | 2/1923 | Whittaker | 272/68 |
| 2,205,161 | 6/1940 | Vick | 272/68 |
| 2,814,491 | 11/1957 | Proctor | 272/68 |
| 4,226,412 | 10/1980 | Panepinto | 272/68 |

FOREIGN PATENT DOCUMENTS

| | | | |
|---|---|---|---|
| 28760 | of 1912 | United Kingdom | 272/68 |

*Primary Examiner*—Richard J. Apley
*Assistant Examiner*—Howard Flaxman
*Attorney, Agent, or Firm*—Jack N. McCarthy

[57] ABSTRACT

A hand exerciser device having a frame with a first and second rod on each end with a third rod being slidably mounted on the frame between the first and second rods, a biasing device forcing the third rod towards the second rod, an adjustment device for changing the distance between the first rod and third rod for exercising one hand. A disconnect connection between the first rod and frame to remove the first rod to provide a two-hand exerciser.

5 Claims, 3 Drawing Sheets

HAND EXERCISER DEVICE

DESCRIPTION

1. Technical Field

This invention relates to an exerciser for developing the muscles of the hand, arm, and chest and increasing ease of movement in the hand.

2. Background Art

Many hand exercising devices are available today, including a rubber ball. Some hand exercisers are shown in the following patents: U.S. Pat. Nos. Re. 28,845; 689,652; 668,473; 965,284; 632,114; 938,348; 3,216,259, 2,205,161; 1,620,910; 3,442,132; and 3,129,939.

SUMMARY OF THE INVENTION

One object of the present invention is to provide a hand exerciser which is adjustable to change the position of the movable inner hand grip with respect to the fixed outer hand grip to account for hand and finger size.

Another object of the invention is to provide a hand exerciser in which the hand grips can be adjusted for use by two or more persons of varying hand sizes.

A further object of the invention is to provide a hand exerciser which can be adjusted for doing different exercises with one hand size.

Another object of this invention is to remove the fixed hand grip and have an exerciser which can be used by both hands at once.

BEST MODE FOR CARRYING OUT THE INVENTION

Figure 1:
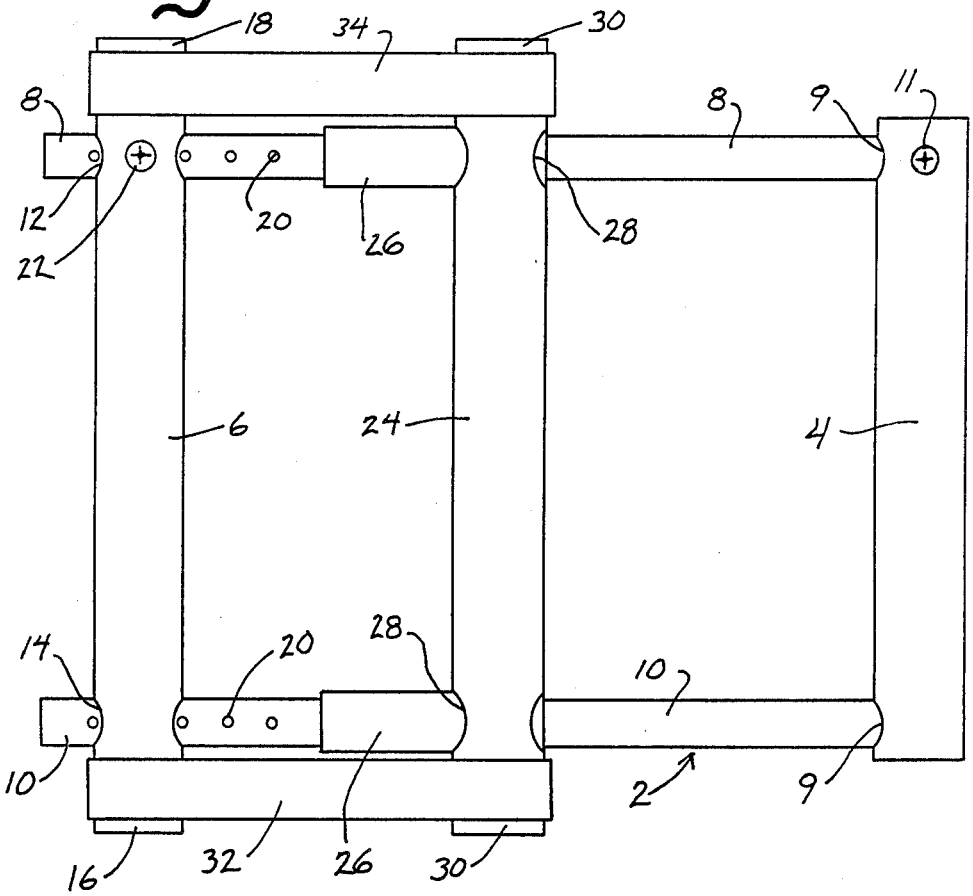
FIG. 1 is a front view of the hand exerciser showing the movable inner hand grip and fixed adjustable outer hand grip biased apart by the elastic bands and showing an adjustment screw and holes.
Figure 2:
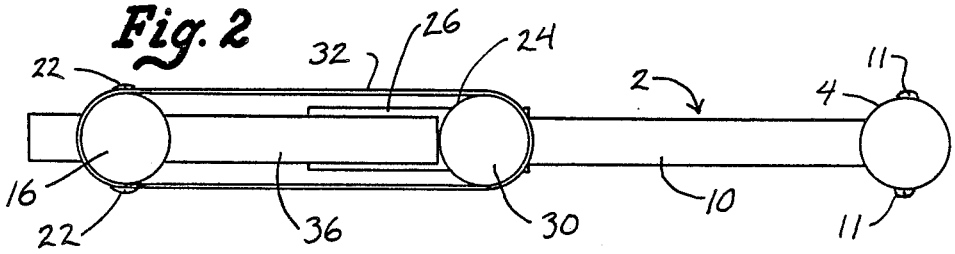
FIG. 2 is an end view of FIG. 1 showing the inner hand grip biased against an end stop rod and showing both adjustment screws.
Figure 3:
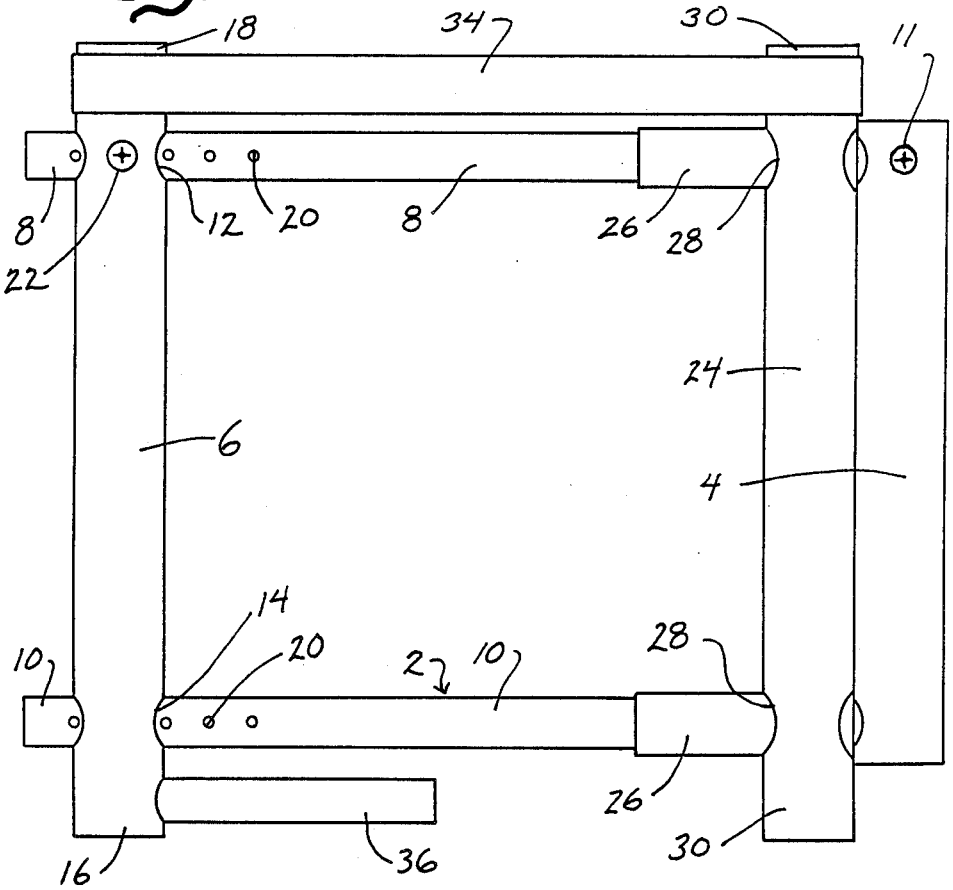
FIG. 3 is a front view of the hand exerciser showing the movable inner hand grip forced against the fixed adjustable outer hand grip with one elastic band removed showing one end stop rod, and the other elastic band stretched.
Figure 4:
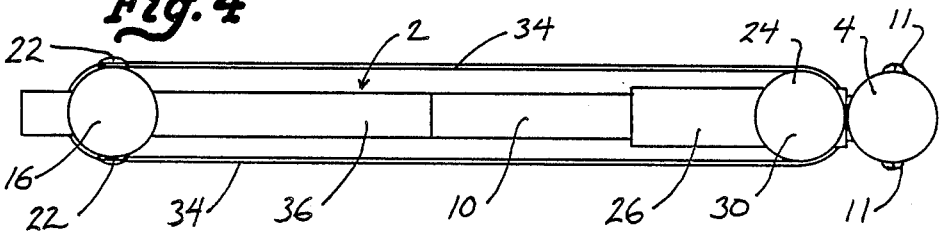
FIG. 4 is an end view of FIG. 3 showing one end stop rod and both adjustment screws.
Figure 5:
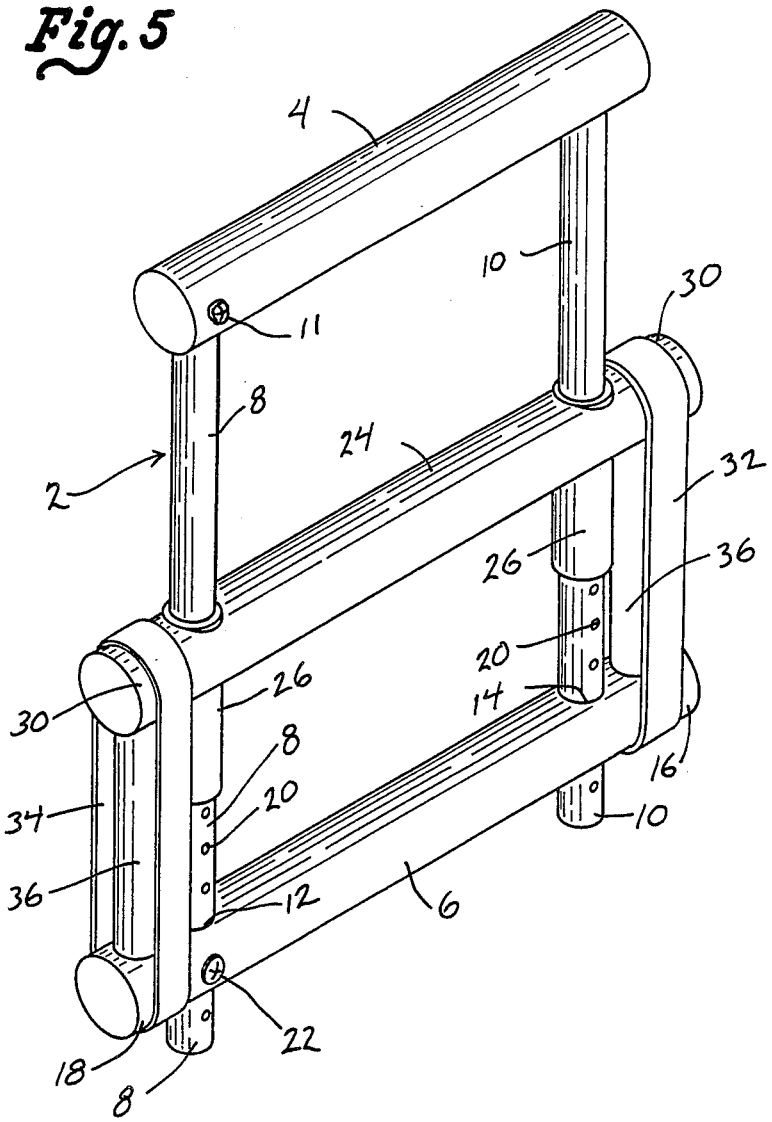
FIG. 5 is a perspective view of the hand exerciser in FIG. 1 showing the countour of the slidable sleeves on the movable inner hand grip and showing an adjustable screw and holes.

As illustrated in the drawings, a frame 2 is shown formed in a substantially rectangular shape. Two larger diameter rods 4 and 6 are located on each end, with their ends connected by smaller diameter rods 8 and 10. Rods 8 and 10 each have one end fixed in a hole 9 in each end of large rod 4 by use of a screw 11. While they have been releasably fixed in this manner, other known fixing means may be used.

The opposite ends of the rods 8 and 10 extend through holes 12 and 14, respectively, located near the ends of the rod 6. A short section 16 of the rod 6 extends outwardly from the hole 14 and a short section 18 of the rod 6 extends outwardly from the hole 12 for a purpose to be hereinafter described. The ends of the rods 8 and 10 each have a plurality of adjustment holes 20 therein to align with a fixed positioning hole in each end of rod 6. One fixed positioning hole in rod 6 intersects the hole 12 while the other fixed positioning hole intersects the hole 14. The fixed positioning holes are located on opposite sides of the rod 6. An adjustment screw 22 is located in each fixed positioning hole, from each side of rod 6, to engage the desired adjustment hole 20 in each rod 8 and 10. This makes a rigid frame 2. As shown in the Figures, the adjustment screws 22 engage the second adjustment hole from each end of the rods 8 and 10.

A third large diameter rod 24 is mounted for slidable movement on rods 8 and 10 between rods 4 and 6. A sleeve 26 is fixed in each of two holes 28, spaced to receive the rods 8 and 10 and be slidable thereon. A short section 30 of the rod 24 extends outwardly from each hole 28 for a purpose to be hereinafter described.

A wide elastic band 32 is placed around short section 16 on rod 6 and aligned short section 30 on rod 24, and a wide elastic band 34 is placed around short section 18 on rod 6 and aligned short section 30 on rod 24. The action of elastic bands 32 and 34 biases rod 24 towards rod 6. Stop members, or rods, 36 project from the short sections 16 and 18 of rod 6 toward the short sections 30 on rod 24, under the wide elastic bands 32 and 34. These stop rods 36 limit the minimum distance between the rod 6 and rod 24 and limit the movement of the rod 24 from the rod 4. The rod 24 and rod 4 form, respectively, the movable inner hand grip and fixed adjustable outer hand grip. The rod 6 forms the fixed rod to which the rod 24 is connected by elastic bands 32 and 34 to resist movement of rod 24 away from rod 6.

In one-hand operation, one's hand extends around the movable inner hand grip rod 24 and fixed outer hand grip rod 4 to draw said rod 24 toward rod 4 and overcome the force of the elastic bands 32 and 34. The rods 24 and 4 can be adjustably spaced apart by placing adjustment screws 22 in the desired holes 20 to provide different spacing for:

(1) adjusting for a large or small hand of a person;
(2) adjusting for use by two or more people having different hand sizes; and
(3) adjusting for doing different exercises with one hand size.

The wide elastic bands 32 and 34 can be made stronger, or weaker, or a plurality of bands can be used on each side to increase forces holding rods 24 and 6 together.

For two-hand operation, the rod 4 can be removed with the rod 6 acting as a second hand grip with inner hand grip 24. One hand grasps rod 6 and the other hand grasps hand grip 24; as the hands are pulled apart the wide elastic bands 34 and 32 are stretched in the same manner as when the exerciser is used as a single hand exerciser. This action reaches muscles of the upper arm and chest.

I claim:

1. An exerciser device having a frame, said frame including a first hand grip rod and a second hand grip rod spaced therefrom, first and second spaced elongated members, first connecting means connecting said first elongated member to said first hand grip rod, second connecting means connecting said second elongated member to said first hand grip rod, third connecting means connecting said first elongated member to said spaced second hand grip rod, fourth connecting means connecting said second elongated member to said spaced second hand grip rod, a third hand grip rod, means mounting said third hand grip rod for slidable movement on said first and second elongated members, means biasing said third hand grip rod towards said second hand grip rod, spacer means between said second hand grip rod and third hand grip rod to limit the minimum spacing therebetween, said biasing means biasing said third hand grip rod against said spacer means, said biasing means located outside of said frame so that there is no interference with any hand grip rod, said first and second connecting means including means for readily disconnecting and connecting said first hand grip rod from said first and second elongated members so that said first hand grip rod can be removed and said second hand grip rod can be grasped by one's hand and said third hand grip rod can be grasped by one's other hand to pull said second and third hand grip rods apart against the force of said biasing means as an alternative to using the device as a single hand grip exerciser.

2. A combination as set forth in claim 1, wherein said second rod is a hand grip rod, said first and second connecting means removably connecting said first elongated member to said first hand grip rod and removably connecting said second elongated member to said first hand grip rod for ready removal and reattachment of said first hand grip rod so that said second hand grip rod can be grasped by one hand passing through said minimum spacing between said second hand grip rod and said third hand grip rod and said third hand grip rod can be grasped by one's other hand passing through said minimum spacing between said second hand grip rod and said third hand grip rod to pull said second and third hand grip rod apart against the force of said biasing means.

3. A combination as set forth in claim 1 wherein said spacer means includes two rods, one rod fixed at one end to said second rod adjacent each first and second elongated members with their other ends contacting said third hand grip rod limiting the minimum spacing therebetween.

4. An exerciser device having a frame (2), said frame (2) including a first hand grip rod (4) and a second rod (6) spaced therefrom, first and second spaced elongated members (8 and 10), first means (11) connecting one end of said first elongated member (8) adjacent one end of said first hand grip rod (4), second means (11) connecting one end of said second elongated member (10) adjacent the other end of said first hand grip rod (4), third adjustable means (20, 22) connecting said first elongated member (8) adjacent one end of said spaced second rod (6), fourth adjustable means (20, 22) connecting said second elongated member (10) adjacent the other end of said spaced second rod (6), a third hand grip rod (24), means (26, 28) mounting said third hand grip rod (24) for slidable movement on said first and second elongated members (8 and 10), means (32, 34) biasing said third hand grip rod (24) towards said second rod (6), spacer means (36) extending between said second rod (6) and third hand grip rod (24) to limit the minimum spacing therebetween, said biasing means (32, 34) having a force biasing said third hand grip rod (24) against said spacer means (36), said second rod (6) and third hand grip rod (24) having their ends (16, 18 and 30) extending a short distance outside of the cooperating elongated members (8 and 10) of said frame (2), said biasing means (32, 34) being connected between the extending ends (16, 30) of said second rod (6) and third hand grip rod (24) outside of said elongated member (8) and the extending ends (18, 30) of said second rod (6) and third hand grip rod (24) outside of said elongated member (10), said third adjustable means (20, 22) and said fourth adjustable means (20, 22) being adjustable when said third hand grip rod (24) is biased against said spacer means (36) at the minimum spacing of said second rod (6) and third hand grip rod (24) to vary the location of said second rod (6) and said third hand grip rod (24) on said first and second elongated members (8 and 10) to change the distance between the first hand grip rod (4) and third hand grip rod (24) without changing the distance between said second rod (6) and said third hand grip rod (24) so that the first hand grip rod (4) and third hand grip rod (24) can be both grasped by one's hand to pull them together against the force of said biasing means (34), and wherein said second rod (6) is a hand grip rod, said first and second connecting means (11) removably connecting said one end of said first elongated member (8) adjacent one end of said first hand grip rod (4) and removably connecting said one end of said second elongated member (10) adjacent the other end of said first hand grip rod (4) for ready removal and reattachment of said first hand grip rod (4) so that said second hand grip rod (6) can be grasped by one's hand and said third hand grip rod (24) can be grasped by one's other hand to pull said second and third hand grip rods (6, 24) apart against the force of said biasing means (32, 34) as an alternative to using the device as a single hand grip exerciser.

5. A combination as set forth in claim 4 with said spacer means (36) being a rod fixed to each extending end (16, 18) of said second rod (6) and extending to contact said cooperating extending ends (30) of said third hand grip rod (24) at their minimum spacing.

* * * * *